US007514618B2

(12) United States Patent
Calato

(10) Patent No.: US 7,514,618 B2
(45) Date of Patent: Apr. 7, 2009

(54) DRUMSTICK AND SYNTHETIC TIP THEREFOR

(75) Inventor: Joseph D. Calato, Niagara Falls, NY (US)

(73) Assignee: J.D. Calato Manufacturing Co., Inc., Niagara Falls, NY (US)

( * ) Notice: Subject to any disclaimer, the term of this patent is extended or adjusted under 35 U.S.C. 154(b) by 0 days.

(21) Appl. No.: 10/454,284

(22) Filed: Jun. 4, 2003

(65) Prior Publication Data

US 2004/0244563 A1 Dec. 9, 2004

(51) Int. Cl.
*G10D 13/02* (2006.01)

(52) U.S. Cl. ..... 84/422.4; 84/422.1

(58) Field of Classification Search ..... 84/422.4, 84/422.1, 422.2; 473/49; D17/22
See application file for complete search history.

(56) References Cited

U.S. PATENT DOCUMENTS

| | | | | | |
|---|---|---|---|---|---|
| 1,221,107 | A | * | 4/1917 | Sullivan | 473/49 |
| 2,473,865 | A | | 6/1949 | Dane | 84/404 |
| 2,775,455 | A | * | 12/1956 | Liberti | 473/568 |
| 3,002,318 | A | * | 10/1961 | Carver | 446/144 |
| 3,577,979 | A | * | 5/1971 | van der Gaast | 600/567 |
| 3,730,570 | A | | 5/1973 | Brochstein | 403/361 |
| 4,040,323 | A | | 8/1977 | Kline | 84/422.4 |
| 4,246,826 | A | | 1/1981 | Warrick et al. | |
| 4,320,688 | A | | 3/1982 | Donohoe | |
| 4,702,143 | A | * | 10/1987 | Brochstein | 84/422.4 |
| D295,872 | S | * | 5/1988 | Koumarianos | D17/22 |
| 5,179,237 | A | | 1/1993 | Grossman | |
| 5,341,716 | A | | 8/1994 | Donohoe | |
| 5,361,671 | A | | 11/1994 | Genna | |
| 5,400,685 | A | * | 3/1995 | Cappella | 84/422.4 |
| 6,326,535 | B1 | | 12/2001 | Pokallus | |
| 6,423,890 | B2 | | 7/2002 | Zbrzezny et al. | |

OTHER PUBLICATIONS

Honey dipper.*
https://www.securewebexchange.com/pinevalleywholesale.com/product_details.asp?prod_ID=1136 &Product=%20(Plastic%20Honey%20Dipper).*
http://www.powells.com/synopses_and_reviews, Aug. 2002.*

* cited by examiner

*Primary Examiner*—Walter Benson
*Assistant Examiner*—Jianchun Qin
(74) *Attorney, Agent, or Firm*—Simpson & Simpson, PLLC

(57) ABSTRACT

A drumstick having a tip of synthetic material, the tip having a plurality of substantially circumferential grooves. A drumstick having a handle portion with a cylindrical shaft and a striking tip extending from one end of the shaft, the striking tip having a substantially spherical conformal cap of synthetic material, the cap having a plurality of substantially circumferential grooves that are disposed in space substantially parallel to one another and substantially equidistantly spaced. The tip of synthetic material may be made from graphite, ceramics, or plastics, preferably nylon.

78 Claims, 6 Drawing Sheets

DRUMSTICK AND SYNTHETIC TIP THEREFOR

FIELD OF THE INVENTION

This invention relates generally to synthetic tips for drumsticks, more particularly, to a durable nylon tip with a plurality of circumferential grooves which produces sounds similar to that produced by wooden tipped drumsticks.

BACKGROUND OF THE INVENTION

The present invention relates generally to a synthetic tip for drumsticks. A variety of drumsticks are known in the art.

U.S. Pat. No. 2,473,865 (Dane) discloses a mallet with a non-metallic, preferably wooden, head. The head has a circumferential groove 15, shown in FIG. 3, that affords a certain amount of motion or "give" to the wood in the region of impact (see column 2, lines 26-31). This patent does not disclose a nylon tip with a plurality of grooves.

U.S. Pat. No. 3,730,570 (Brochstein) discloses a drumstick with a tip constructed from a relatively flexible or comparatively soft plastic material. FIG. 2 discloses that frictional enhancement results between tip 5 and stick 3 by the presence of knurled or roughened surface 21 on the exterior of the reduced end 7 of the stick and underneath the tip. The description of FIG. 3 (column 2, lines 46-49) indicates that the roughened or knurled surface 21 is generally circumferentially disposed about the entire stick surface. Furthermore, FIG. 5 (column 2, lines 58-62) illustrates a stick with a circumferentially located groove-like receiving shoulder 25a which is an integral part of the tip itself. Shoulder 25a engages recess 27a on the circumference of the stick. This patent focuses on improving the means by which the tip is affixed to the end of a drumstick. The roughed or knurled surface and the groove-like receiving shoulder are features of the stick rather than the tip. There is no teaching of circumferential grooves to provide sound like that produced by a wooden tipped drumstick.

U.S. Pat. No. 4,040,323 (Kline) teaches a synthetic material drumstick formed from solid polyester resin reinforced with glass roving fibers. This patent teaches a solid drumstick, with no separate tip, and does not disclose a plurality of circumferential grooves about the tip of the stick.

U.S. Pat. No. 4,246,826 (Warrick et al.) discloses a wooden drumstick with a flexible fiberglass rod to which a nylon tip may be attached. There is no teaching of the nylon tip having a plurality of circumferential grooves.

U.S. Pat. No. 4,320,688 (Donohoe) teaches a synthetic drumstick with a molded plastic skin and a striking tip which may be made of nylon. The patent discloses the benefits of using synthetic materials such as nylon for drumsticks. However, there is no teaching about the nylon tip having circumferential grooves.

U.S. Pat. No. 5,179,237 (Grossman) invention is a drumstick with a metal core, an elongated elastomeric sheath removably mounted on the tapered portion of the metal core, and a rounded striking which may be made of nylon. Again, there is no teaching of the tip having circumferential grooves.

U.S. Pat. No. 5,341,716 (Donohoe) discloses a wooden drumstick with an elongated tubular sleeve. The sleeve is made of a fiberglass filled polymer, preferably nylon filled with 40% fiberglass. There is no teaching of the nylon sleeve having circumferential grooves.

U.S. Pat. No. 5,361,671 (Genna) discloses a resilient drumstick sleeve assembly comprising a wooden drumstick and a resilient tubular sleeve fitted onto the neck of the drumstick.

The sleeve may be made of a polymer, preferably a polypropylene, polyethylene, polyurethane, or a vinyl elastomer. Again, there is no teaching of the polymeric sleeve having circumferential grooves.

U.S. Pat. No. 5,400,685 (Cappella) discloses a drumstick with a striking tip that has a plastic cap affixed to it. Nylon is the preferred material for the plastic cap. As shown in FIGS. 1 and 2, the plastic cap 5, is provided with a shallow groove 6, to which a hard, rigid ring 7, is attached (see column 2, lines 42-50). However, it should be noted that shallow groove 6 is apparently inaccurately illustrated in the patent drawings. The outer surface of the ring is somewhat raised from the surface of the cap 5, such that upon impact with a cymbal, the ring 7 will impact before the remainder of the striking tip 2. The presence of the shallow groove in the cap is not particularly relevant because the groove is "filled in" with ring 7.

U.S. Pat. No. 6,423,890 (Zbrzezny et al.) relates to an improved grip for a drumstick. U.S. Pat. No. 6,326,535 (Pokallus) discloses a drumstick that has a hot stamp foil layer applied to the striking end of the drumstick body, which minimizes blemishing of a percussion instrument. Neither of these patents discloses circumferential grooves on the drumstick tip.

What is needed, then, is a drumstick with a durable tip of synthetic material, the tip having a plurality of substantially circumferential grooves which produces sounds similar to that produced by a wood tip drumstick.

SUMMARY OF THE INVENTION

The present invention broadly comprises a tip of synthetic material, the tip having a plurality of substantially circumferential grooves.

In one embodiment, the present invention broadly comprises a handle portion with a cylindrical shaft and a striking tip extending from one end of the shaft, the striking tip having a substantially spherical conformal cap of synthetic material, the cap having a plurality of substantially circumferential grooves that are disposed in space substantially parallel to one another and substantially equidistantly spaced.

In another embodiment, the present invention broadly comprises a tip of synthetic material, the tip having a plurality of circumferential grooves, some of which are fully or partially blocked.

A general object of the invention is to provide a synthetic tip drumstick comprising a substantially circumferentially grooved tip of a plastic material.

These and other objects, features, and advantages of the present invention will become readily apparent to those having ordinary skill in the art upon reading the following detailed description of the invention in view of the several drawings of the invention.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments.

Figure 1:
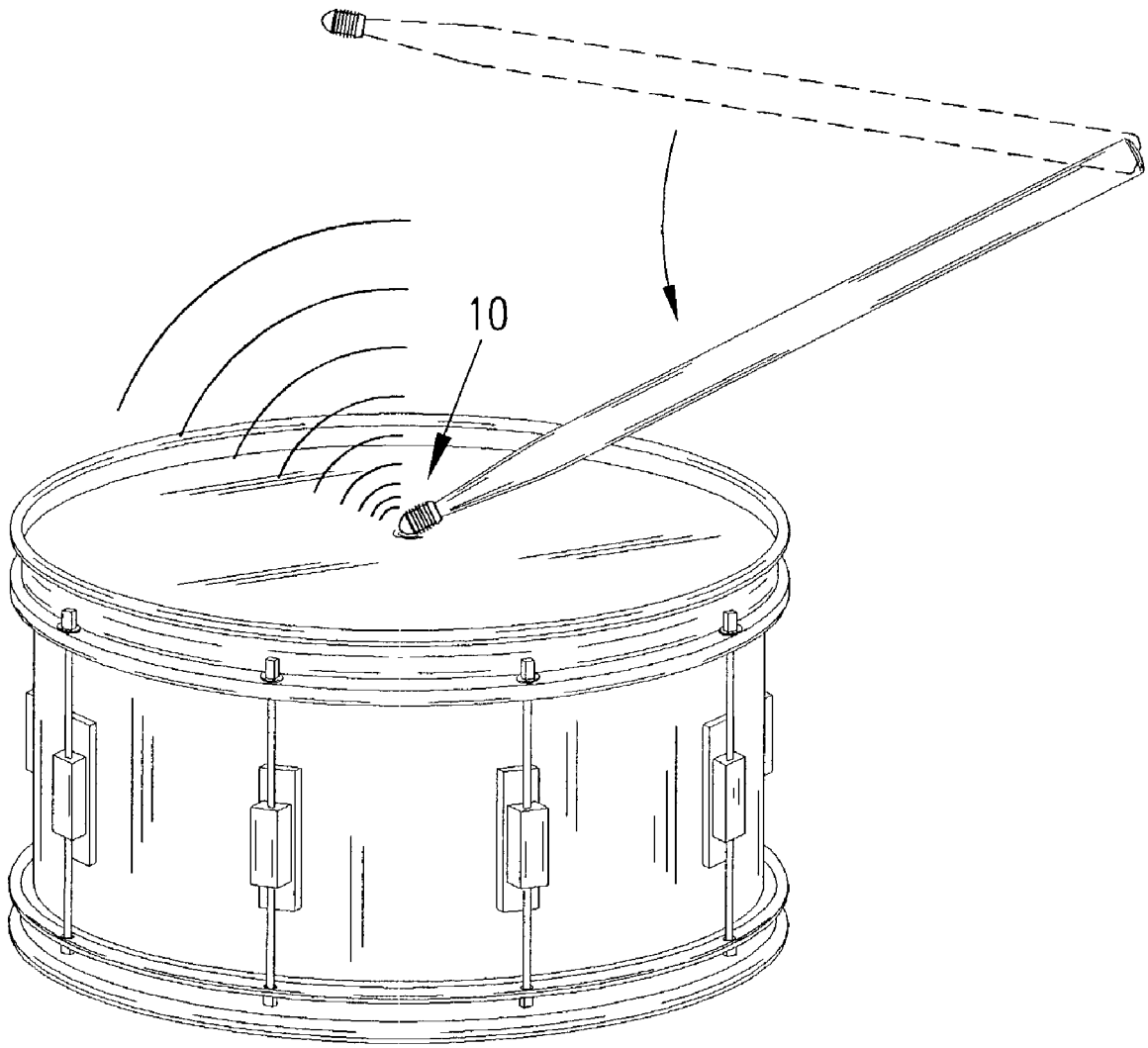
FIG. 1 is a perspective view of a drumstick striking a drum to produce sound.
Figure 2:
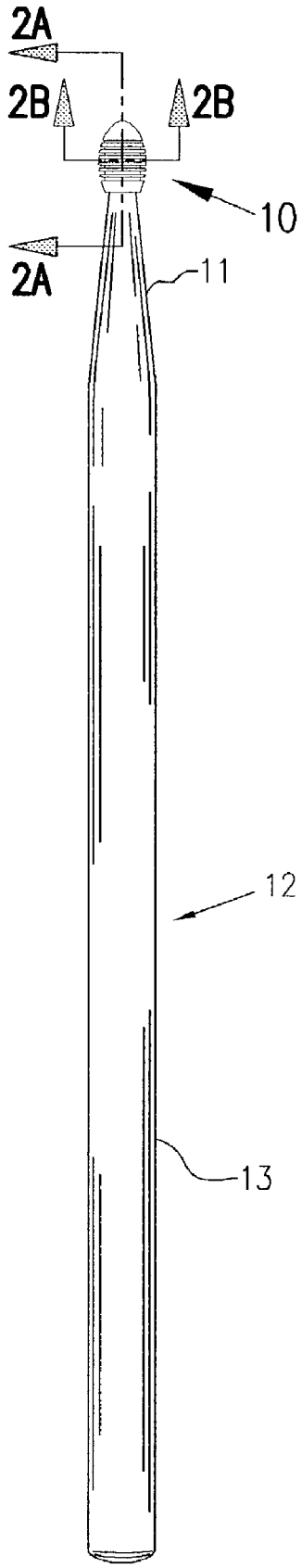
FIG. 2 is a perspective view of a first embodiment of the present invention.

FIG. 1 is a perspective view of a first embodiment of the present invention comprising a drumstick striking a drum to produce sound. While the embodiments shown all relate to drumsticks, it is contemplated that the features of the instant drumstick tip may be incorporated into sticks or mallets for striking any musical instrument. For example, percussion instruments such as xylophones, marimbas, chimes, gongs, glockenspiels, vibraharps, and resonator bells may be stuck with the tip of the present invention to produce various sounds;

FIG. 2 is a perspective view of a first embodiment of the present invention shown in FIG. 1, except viewed in greater detail. The tip is substantially spherical or ovoid but variations in shape may be necessary to adapt the tip to variations in form at the striking end of a drumstick. Thus, the axial cross section of the tip, shown in FIG. 2B, can take the form of a variety of geometric shapes, including but not limited to round (circular), polygonal (triangular, rectangular, pentagonal, etc.), asymmetric, etc.

The tip may be attached to handle portion 12, with neck region 11 and cylindrical shaft region 13. Neck region 11 extends from one end of shaft 13 and connects handle portion 12 to tip 10. Handle portion 12 may be composed of any material such as wood, graphite, ceramics, or plastics. The tip may be composed of a synthetic material such as graphite, ceramics, and plastics. For example, the tip may be made from a plastic such as polycarbonate, polyamide, polyvinyl chloride, phenol formaldehyde, polymethyl metacrylate, and polypropylene. Even more specifically, the tip may be made of nylon. Details of nylon production can be found in various references understood by those of skill in the art such as The Nylon Plastics Handbook by Melvin I. Kohan (Editor); Hanser Gardner Pubns; (September 1995) incorporated herein in its entirety.

The grooves may be formed by any method known in the art. For example, the grooves may be machined in a tip using a lathe, or the tip may be molded with the grooves in the desired configuration. Combination drumsticks and tips or separate tips made by any method known in the art are within the spirit and scope of the invention as claimed.

Figure 2A:
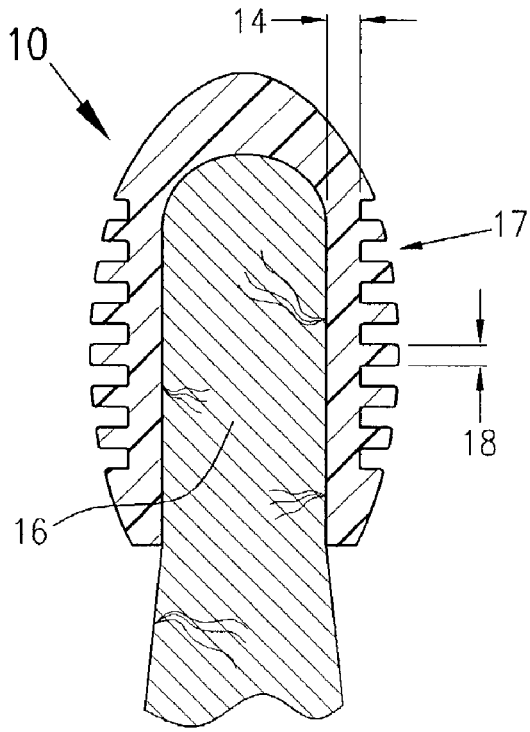
FIG. 2A is a cross-sectional view of the tip of the drumstick shown in FIG. 2, taken generally along line 2A of FIG. 2.

In FIG. 2A, the tip has substantially circumferential grooves which are disposed in space substantially parallel to one another and disposed in space substantially perpendicular with respect to a longitudinal axis of the drumstick. Of course, the number of circumferential grooves may vary. For example, in one embodiment tip 10 may contain six grooves 17 of width 0.030 inches spaced 0.030 inches apart (the spacing between grooves 17 is distance 18 on FIG. 2A). In another embodiment tip 10 may contain seven grooves 17 of width 0.025 inches spaced 0.025 inches apart (distance 18). In one embodiment, the tip has a length of 0.580 inches and a width of 0.390 inches. In this embodiment, groove 17 may begin 0.150 inches from the top of the tip and end 0.100 inches from the bottom of the tip.

In the embodiment shown in FIG. 2A, each of the substantially circumferential grooves is substantially square in shape. In one embodiment, thickness 14 between the bottom of the groove and the hollow interior of the tip is 0.030 inches. Although thickness 14 is shown as being consistent throughout, it is contemplated that thickness 14 may vary.

Furthermore, in a preferred embodiment, the substantially circumferential grooves are disposed in space substantially parallel to one another and substantially equidistantly spaced. However, it should be understood that variations such as the distance between each of the grooves, the shape of the grooves and the depth of each of the grooves are within the spirit and scope of the present invention as claimed.

Figure 2B:
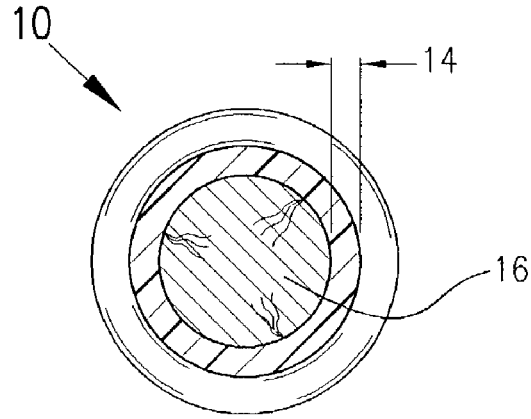
FIG. 2B is a top view of the tip of the drumstick shown in FIG. 2, taken generally along line 2B in FIG. 2.

FIG. 2B is a top view taken along 2B of FIG. 2. Tip 10 is shown as a conformal cap which fits over wooden drumstick core 16. FIGS. 2A and 2B depict the tip as a solid throughout its structure.

Figure 3:
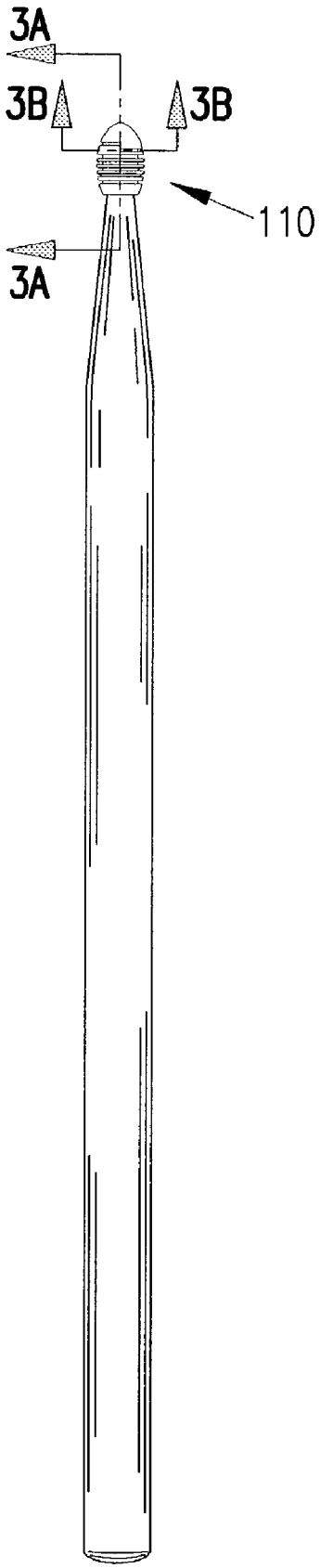
FIG. 3 is a perspective view of a second embodiment of the present invention.
Figure 3A:
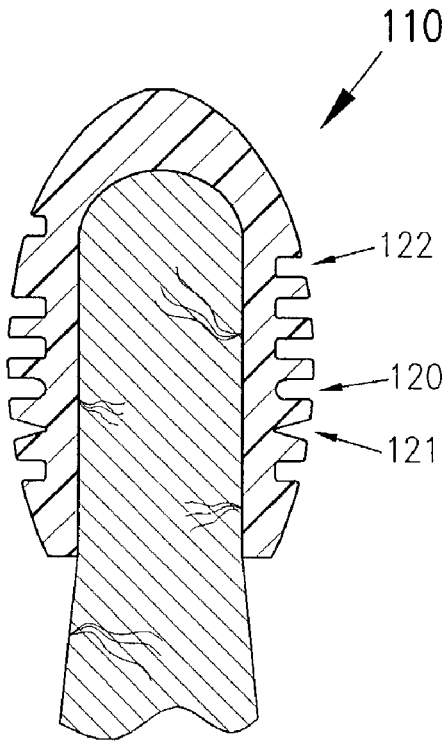
FIG. 3A is a cross-sectional view of the tip of the drumstick shown in FIG. 3, taken generally along line 3A of FIG. 3.

FIG. 3 is a perspective view of a second embodiment of the present invention, designated 110. FIG. 3A is an exploded cross-sectional view of tip 110 shown in FIG. 3. The term "groove" includes, but is not limited to grooves that are substantially square-shaped, U-shaped, or V-shaped. A plurality of the various types of grooves is shown. For example, groove 120 is an example of a U-shaped groove and groove 121 is an example of a V-shaped groove. Groove 122 is an example of a substantially square shaped groove. Variations, permutations, and combinations on such an embodiment are also intended to be within the spirit and scope of the invention as claimed.

Figure 3B:
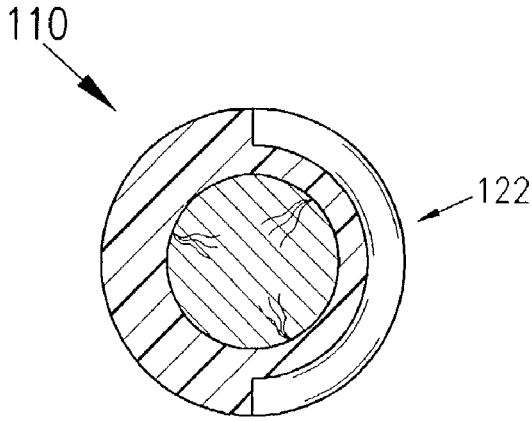
FIG. 3B is a top view of the tip of the drumstick shown in FIG. 3, taken generally along line 3B in FIG. 3.

As shown in FIG. 3B, one or more of the grooves may be fully or partially blocked. Groove 122 is partially blocked, as it is filled in along half of the circumference of the tip. Further, each of the grooves may have more than one blockage such that subtle variations in sound may be produced when an instrument is struck with the tip. Such variations in the extent and number of occlusions, obstructions, or blockages within the grooves are intended to be within the spirit and scope of the invention as claimed.

Figure 4:
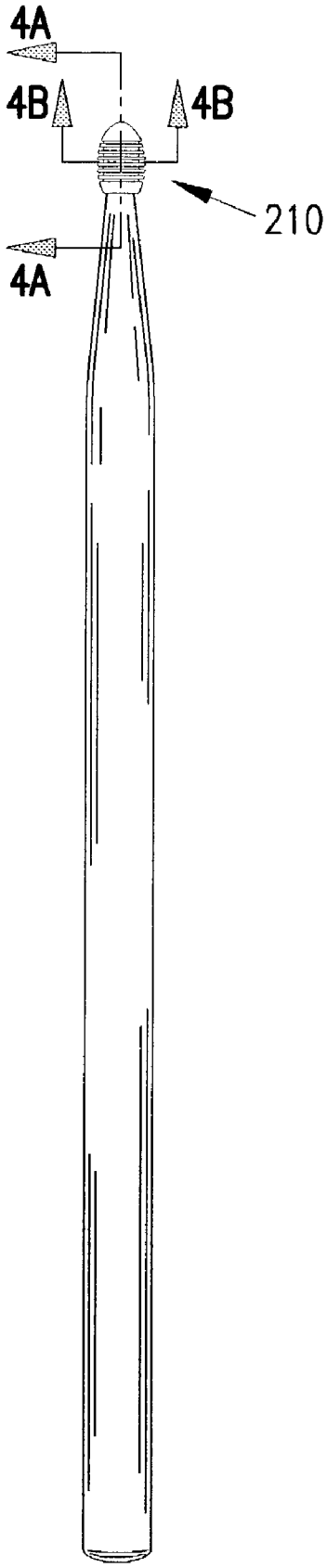
FIG. 4 is a perspective view of a third embodiment of the present invention.
Figure 4A:
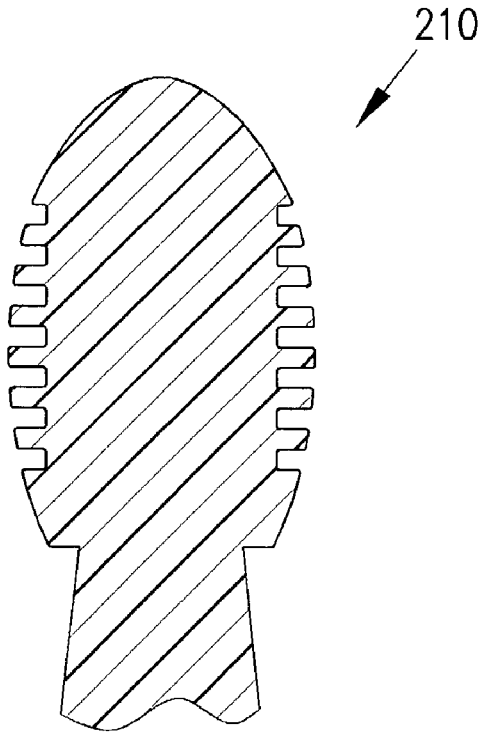
FIG. 4A is a cross-sectional view of the tip of the drumstick shown in FIG. 4, taken generally along line 4A of FIG. 4.
Figure 4B:
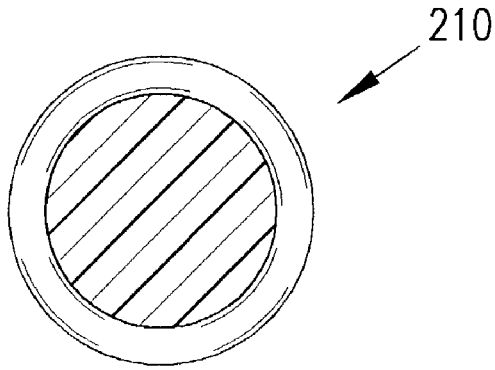
FIG. 4B is a top view of the tip of the drumstick shown in FIG. 4, taken generally along line 4B in FIG. 4.

FIGS. 4, 4A, and 4B illustrate a third embodiment of the present invention where the tip is formed integrally with the drumstick. Unitary stick and tip 210 may be constructed from nylon, graphite, ceramic, or plastic. For example, the unitary stick and tip may be made from a plastic such as polycarbonate, polyamide, polyvinyl chloride, phenol formaldehyde, polymethyl metacrylate, or polypropylene.

Figure 5:
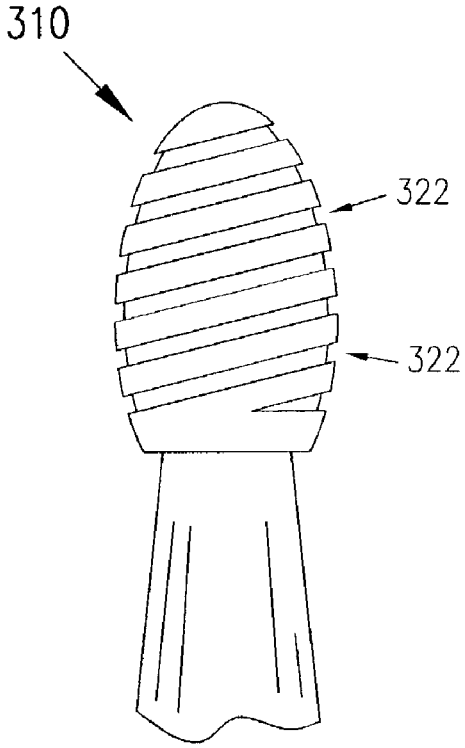
FIG. 5 is a perspective view of a fourth embodiment of the present invention.

FIG. 5 is a perspective view of a fourth embodiment of the present invention showing spiral grooved tip 310. As in FIGS. 2A, 3A and 4A, this tip has substantially circumferential grooves 322 which are disposed in space substantially parallel to one another. However, unlike the previous embodiments, the grooves in FIG. 5 are not disposed in space substantially perpendicular with respect to a longitudinal axis of the drumstick. Instead the grooves are at an angle with respect to a longitudinal axis. The invention also contemplates the groove being a single, continuous groove that spirals around the tip. Variations in the extent of the angle formed by the groove with respect to the longitudinal axis of the drumstick are also intended to be within the spirit and scope of the invention as claimed.

Figure 6:
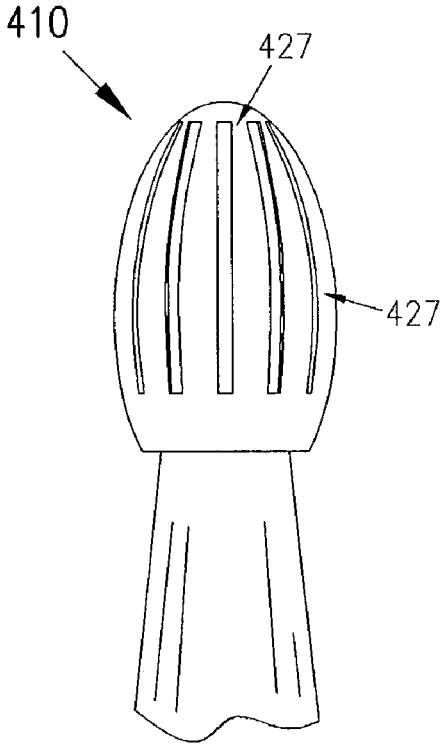
FIG. 6 is a perspective view of a fifth embodiment of the present invention.

As illustrated in FIG. 6, a fifth embodiment of the present invention may include a plurality of vertical grooves 427 on tip 410. These grooves are shown as radially spiral and equally spaced. However, variations, combinations and permutations in the number of vertical grooves, the distance between the vertical grooves, the depth of the grooves, the shape of the grooves, and the presence of one or more obstructions within the groove are also intended to be within the spirit and scope of the invention as claimed.

Figure 7:
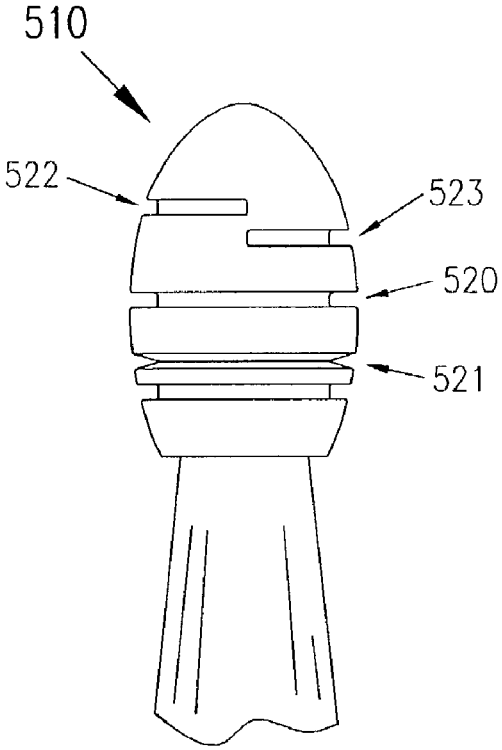
FIG. 7 is a perspective view of a sixth embodiment of the present invention.

FIG. 7 is a perspective view of a sixth embodiment of tip 510 in which several of the substantially circumferential grooves are partially blocked. This embodiment represents an enlarged view of a variant of the tip shown in FIG. 3 in which horizontal grooves 522 and 523 are blocked. Thus, the invention contemplates a tip of synthetic material wherein the tip has a plurality of grooves with obstructions/blockages that prevent the grooves from extending along the entire circumference of the tip. Groove 520 is another example of a U-shaped groove and groove 521 is an example of a V-shaped groove.

Figure 8A:
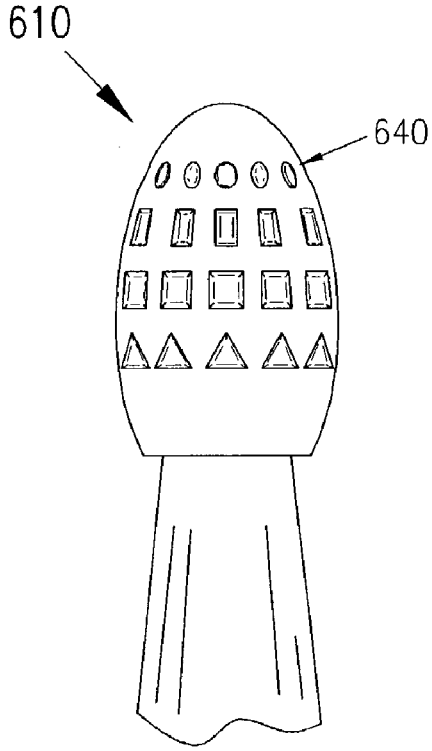
FIG. 8A is a perspective view of a seventh embodiment of the present invention.

FIG. 8A shows a perspective view of a seventh embodiment of tip 610 illustrating yet more variations on the size, shape and depth of the grooves. For example, the top row of deeper, circular grooves 640 creates a dimpled region on the tip. These grooves of different shapes (circular, rectangular, square, triangular, etc.), sizes and depths form depressions on the tip that can change the sound that is produced when an instrument is struck with the tip. Variations, permutations, and combinations on such an embodiment are also intended to be within the spirit and scope of the invention as claimed.

Figure 8B:
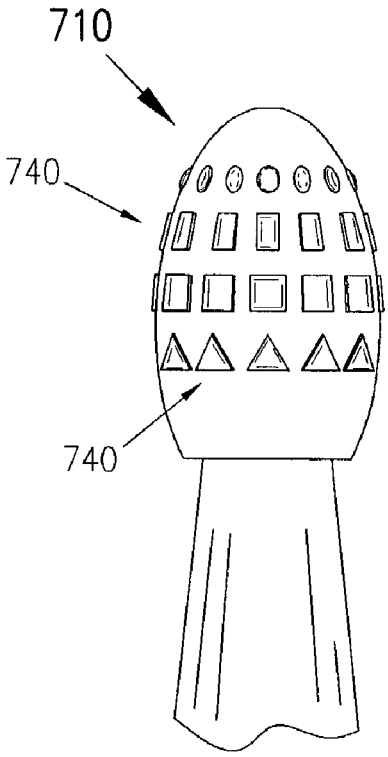
FIG. 8B is a perspective view of an eighth embodiment of the present invention.

FIG. 8B is a perspective view of an eight embodiment of the present invention showing irregular protuberances 740 on tip 710. The protuberances of different shapes (circular, rectangular, square, triangular, etc.), sizes and heights create irregular shaped "valleys" and "troughs" on the surface of the tip. Thus, in such an embodiment, protuberances 740 are the contact region between the tip and the instrument. Protuberances 740 may, in turn, have grooves of assorted shapes, sizes and depths and such alternatives are also contemplated.

Figure 9:
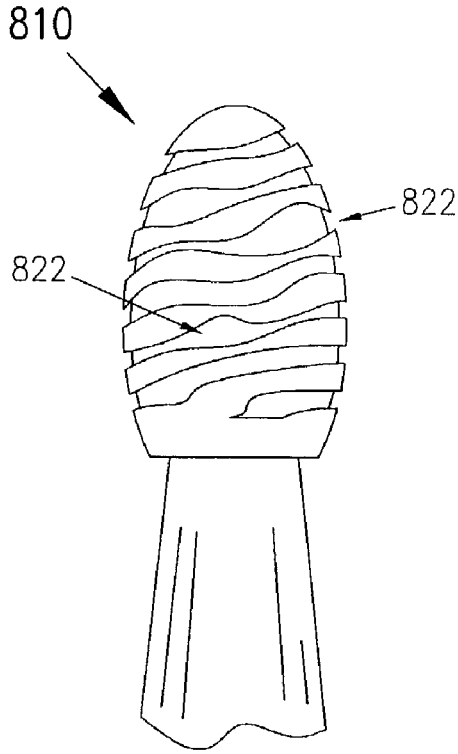
FIG. 9 is a perspective view of a ninth embodiment of the present invention.

FIG. 9 is a perspective view of a ninth embodiment of the present invention showing an irregular grooved tip 810. The embodiment is a variant of the tip shown in FIG. 5 wherein the tip has substantially circumferential grooves 822 which are disposed in space substantially parallel to one another. The invention also contemplates the groove being a single, continuous groove that spirals irregularly and partially around the tip.

Figure 10:
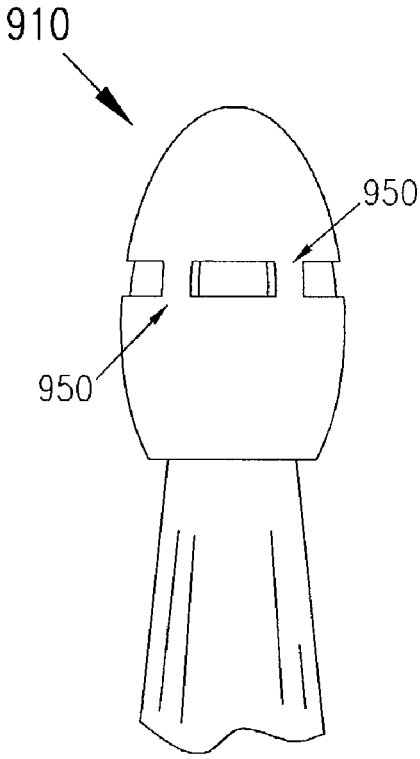
FIG. 10 is a perspective view of a tenth embodiment of the present invention; and, FIG. 11 is a perspective view of an eleventh embodiment of the present invention.

FIG. 10 illustrates a tenth embodiment of tip 910 with a single circumferential groove that has several occlusions/blockages 950. The plurality of blockages 950 within the single circumferential groove on the tip of the drumstick differentiates this embodiment from references in the art.

Figure 11:
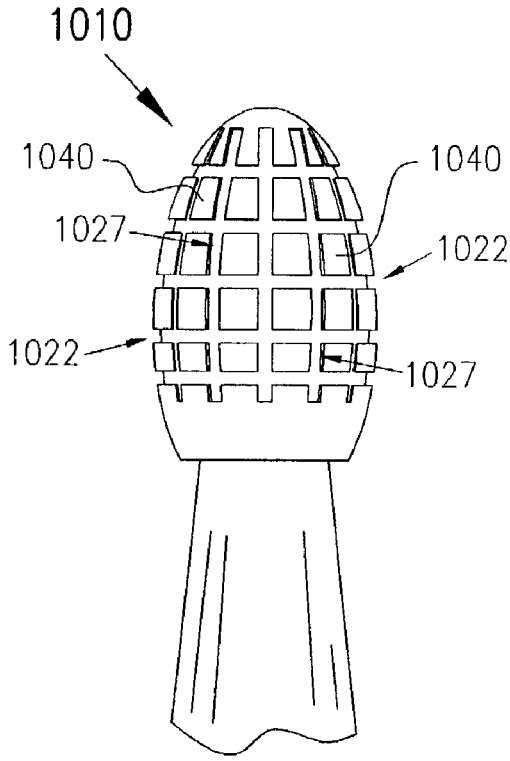

FIG. 11 is a perspective view of an eleventh embodiment in which multiple vertical grooves 1027 and multiple horizontal grooves 1022 intersect or overlap each other to form square shaped protuberances 1040 on tip 1010. As in the other embodiments, the invention contemplates variants in which the grooves are not at right angles to each other, grooves that criss-cross so as to form diamond shaped protuberances, additional grooves on the protuberances, and other alternatives and substitutions.

Thus it is seen that the objects of the invention are efficiently obtained, although changes and modifications to the invention should be readily apparent to those having ordinary skill in the art, which changes are considered to be within the scope of the invention as claimed. Variations, permutations, and combinations on such embodiments are also intended to be within the spirit and scope of the invention as claimed.

What is claimed is:

1. A drumstick comprising a shaft and a tip of synthetic material, said tip having a plurality of substantially circumferential grooves and wherein said tip is solid in construction from the bottom of said grooves to said shaft and wherein said plurality of grooves forms a striking surface of said drumstick tip;

wherein each of said plurality of substantially circumferential grooves ranges in width from about 0.025 inches to about 0.030 inches; and, wherein said synthetic striking surface produces the sound of a wooden tip when said tip strikes a drum or cymbal.

2. The drumstick recited in claim 1, wherein said tip is substantially spherical.

3. The drumstick recited in claim 1, wherein said substantially circumferential grooves are disposed in space substantially parallel to one another and disposed in space substantially perpendicular with respect to a longitudinal axis of said drumstick.

4. The drumstick recited in claim 1, wherein said substantially circumferential grooves are disposed in space substantially parallel to one another and disposed in space substantially parallel with respect to a longitudinal axis of said drumstick.

5. The drumstick recited in claim 1, wherein said substantially circumferential grooves are disposed in space substantially parallel to one another and substantially equidistantly spaced.

6. The drumstick recited in claim 1, wherein said tip is attached to a handle portion with a neck region and a cylindrical shaft region, said neck region extending from one end of said shaft and connecting said tip to said handle portion.

7. The drumstick recited in claim 6, wherein said handle portion is selected from a group consisting of wood, graphite, ceramics, and plastics.

8. The drumstick recited in claim 1, wherein said tip is nylon.

9. The drumstick recited in claim 1, wherein said tip of synthetic material is selected from a group consisting of graphite, ceramics, and plastics.

10. The drumstick recited in claim 9, wherein said tip is a plastic selected from a group consisting of polycarbonate, polyamide, polyvinyl chloride, phenol formaldehyde, polymethyl metacrylate, and polypropylene.

11. The drumstick recited in claim 1, wherein each of said substantially circumferential grooves is substantially square in shape.

12. The drumstick recited in claim 1, wherein each of said substantially circumferential grooves is substantially V-shaped.

13. The drumstick recited in claim 1, wherein each of said substantially circumferential grooves is substantially U-shaped.

14. The drumstick recited in claim 1, wherein a plurality of said plurality of substantially circumferential grooves intersects.

15. The drumstick recited in claim 1, wherein at least one of said plurality of substantially circumferential grooves is partially blocked.

16. A drumstick comprising a handle portion with a cylindrical shaft and a striking tip extending from one end of said shaft, said striking tip having a substantially spherical conformal cap of synthetic material, said cap having a plurality of substantially circumferential grooves that are disposed in space substantially parallel to one another and substantially equidistantly spaced wherein said cap is solid in structure from the bottom of said grooves to said one end of said shaft and wherein said plurality of substantially circumferential grooves form a striking surface of said striking tip;

wherein each of said plurality of substantially circumferential grooves ranges in width from about 0.025 inches to about 0.030 inches; and, wherein said synthetic striking surface produces the sound of a wooden tip when said tip strikes a drum or cymbal.

17. The drumstick recited in claim 16, wherein said substantially circumferential grooves are disposed in space substantially perpendicular with respect to a longitudinal axis of said handle portion.

18. The drumstick recited in claim 16, wherein said substantially circumferential grooves are disposed in space substantially parallel with respect to a longitudinal axis of said handle portion.

19. The drumstick recited in claim 16, wherein said handle portion is selected from a group consisting of wood, graphite, ceramics, and plastics.

20. The drumstick recited in claim 16, wherein said tip is nylon.

21. The drumstick recited in claim 16, wherein said tip of synthetic material is selected from a group consisting of graphite, ceramics, and plastics.

22. The drumstick recited in claim 21, wherein said tip is a plastic selected from a group consisting of polycarbonate, polyamide, polyvinyl chloride, phenol formaldehyde, polymethyl metacrylate, and polypropylene.

23. The drumstick recited in claim 16, wherein each of said substantially circumferential grooves is substantially square in shape.

24. The drumstick recited in claim 16, wherein each of said substantially circumferential grooves is substantially V-shaped.

25. The drumstick recited in claim 16, wherein each of said substantially circumferential grooves is substantially U-shaped.

26. The drumstick recited in claim 16, wherein a plurality of said plurality of substantially circumferential grooves intersects.

27. The drumstick recited in claim 16, wherein at least one of said plurality of substantially circumferential grooves is partially blocked.

28. A tip made from synthetic material for attachment to a drumstick, said tip comprising a plurality of substantially circumferential grooves wherein said tip is solid in construction and wherein said plurality of circumferential grooves form a striking surface of said synthetic tip for a drumstick; wherein each of said plurality of substantially circumferential grooves ranges in width from about 0.025 inches to about 0.030 inches; and, wherein said synthetic striking surface produces the sound of a wooden tip when said tip strikes a drum or cymbal.

29. The tip recited in claim 28, wherein said tip is substantially spherical.

30. The tip recited in claim 28, wherein said substantially circumferential grooves are disposed in space substantially parallel to one another and disposed in space substantially perpendicular with respect to a longitudinal axis of said drumstick.

31. The tip recited in claim 28, wherein said substantially circumferential grooves are disposed in space substantially parallel to one another and disposed in space substantially parallel with respect to a longitudinal axis of said drumstick.

32. The tip recited in claim 28, wherein said substantially circumferential grooves are disposed in space substantially parallel to one another and substantially equidistantly spaced.

33. The tip recited in claim 28, wherein said tip is made of a synthetic material selected from a group consisting of nylon, graphite, ceramic, and plastic.

34. The tip recited in claim 33, wherein said tip is a plastic selected from a group consisting of polycarbonate, polyamide, polyvinyl chloride, phenol formaldehyde, polymethyl metacrylate, and polypropylene.

35. The tip recited in claim 28, wherein each of said substantially circumferential grooves is substantially square in shape.

36. The tip recited in claim 28, wherein each of said substantially circumferential grooves is substantially V-shaped.

37. The tip recited in claim 28, wherein each of said substantially circumferential grooves is substantially U-shaped.

38. The tip recited in claim 28, wherein a plurality of said plurality of substantially circumferential grooves intersects.

39. The tip recited in claim 28, wherein at least one of said plurality of substantially circumferential grooves is partially blocked.

40. A drumstick comprising a shaft and an integral tip each made from a synthetic material, said tip comprising a plurality of substantially circumferential grooves wherein said tip is solid in construction from the bottom of said grooves to said shaft and wherein the surfaces between said plurality of substantially circumferential grooves form a striking surface for said integral tip wherein each of said plurality of substantially circumferential grooves ranges in width from about 0.025 inches to about 0.030 inches; and, wherein said synthetic striking surface produces the sound of a wooden tip when said tip strikes a drum or cymbal.

41. The drumstick recited in claim 40, wherein said tip is substantially spherical.

42. The drumstick recited in claim 40, wherein said substantially circumferential grooves are disposed in space substantially parallel to one another and disposed in space substantially perpendicular with respect to a longitudinal axis of said drumstick.

43. The drumstick recited in claim 40, wherein said substantially circumferential grooves are disposed in space substantially parallel to one another and disposed in space substantially parallel with respect to a longitudinal axis of said drumstick.

44. The drumstick recited in claim 40, wherein said substantially circumferential grooves are disposed in space substantially parallel to one another and substantially equidistantly spaced.

45. The drumstick recited in claim 40, wherein said drumstick is made of a synthetic material selected from a group consisting of nylon, graphite, ceramic, and plastic.

46. The drumstick recited in claim 40, wherein said drumstick is a plastic selected from a group consisting of polycarbonate, polyamide, polyvinyl chloride, phenol formaldehyde, polymethyl metacrylate, and polypropylene.

47. The drumstick recited in claim 40, wherein each of said substantially circumferential grooves is substantially square in shape.

48. The drumstick recited in claim 40, wherein each of said substantially circumferential grooves is substantially V-shaped.

49. The drumstick recited in claim 40, wherein each of said substantially circumferential grooves is substantially U-shaped.

50. The drumstick recited in claim 40, wherein a plurality of said plurality of substantially circumferential grooves intersects.

51. The drumstick recited in claim 40, wherein at least one of said plurality of substantially circumferential grooves is partially blocked.

52. A drumstick comprising a shaft and a tip of synthetic material, said tip having a plurality of substantially circumferential protuberances and a plurality of substantially circumferential grooves, each of said plurality of substantially circumferential grooves adjacent to at least one of said substantially circumferential protuberances wherein said tip is solid in construction from the bottom of said grooves to said shaft and wherein said plurality of substantially circumferential protuberances form a striking surface for said tip; and, wherein each of said plurality of substantially circumferential grooves ranges in width from about 0.025 inches to about 0.030 inches; and, wherein said synthetic surface produces the sound of a wooden tip when said tip strikes a drum or cymbal.

53. The drumstick recited in claim 52, wherein said tip is substantially spherical.

54. The drumstick recited in claim 52, wherein said substantially circumferential protuberances are disposed in space substantially parallel to one another and disposed in space substantially perpendicular with respect to a longitudinal axis of said drumstick.

55. The drumstick recited in claim 52, wherein said substantially circumferential protuberances are disposed in space substantially parallel to one another and disposed in space substantially parallel with respect to a longitudinal axis of said drumstick.

56. The drumstick recited in claim 52, wherein said substantially circumferential protuberances are disposed in space substantially parallel to one another and substantially equidistantly spaced.

57. The drumstick recited in claim 52, wherein said tip is attached to a handle portion with a neck region and a cylindrical shaft region, said neck region extending from one end of said shaft and connecting said tip to said handle portion.

58. The drumstick recited in claim 52, wherein said handle portion is selected from a group consisting of wood, graphite, ceramics, and plastics.

59. The drumstick recited in claim 52, wherein said tip is nylon.

60. The drumstick recited in claim 52, wherein said tip of synthetic material is selected from a group consisting of graphite, ceramics, and plastics.

61. The drumstick recited in claim 60, wherein said tip is a plastic selected from a group consisting of polycarbonate, polyamide, polyvinyl chloride, phenol formaldehyde, polymethyl metacrylate, and polypropylene.

62. The drumstick recited in claim 52, wherein each of said substantially circumferential protuberances is substantially square in shape.

63. The drumstick recited in claim 52, wherein each of said substantially circumferential protuberances is substantially V-shaped.

64. The drumstick recited in claim 52, wherein each of said substantially circumferential protuberances is substantially U-shaped.

65. The drumstick recited in claim 52, wherein a plurality of said plurality of substantially circumferential protuberances intersects.

66. The drumstick recited in claim 52, wherein at least one of said plurality of substantially circumferential protuberances is partially grooved.

67. A drumstick comprising a shaft and an integral tip each made from a synthetic material, said tip comprising a plurality of substantially circumferential protuberances and a plurality of substantially circumferential grooves, each of said plurality of substantially circumferential grooves adjacent to at least one of said substantially circumferential protuberances wherein said tip is solid in construction from the bottom of said grooves to said drumstick and wherein said plurality of substantially circumferential protuberances form a striking surface of said integral tip;

wherein each of said plurality of substantially circumferential grooves ranges in width from about 0.025 inches to about 0.030 inches; and, wherein said synthetic surface produces the sound of a wooden tip when said tip strikes a drum or cymbal.

68. The drumstick recited in claim 67, wherein said tip is substantially spherical.

69. The drumstick recited in claim 67, wherein said substantially circumferential protuberances are disposed in space substantially parallel to one another and disposed in space substantially perpendicular with respect to a longitudinal axis of said drumstick.

70. The drumstick recited in claim 67, wherein said substantially circumferential protuberances are disposed in space substantially parallel to one another and disposed in space substantially parallel with respect to a longitudinal axis of said drumstick.

71. The drumstick recited in claim 67, wherein said substantially circumferential protuberances are disposed in space substantially parallel to one another and substantially equidistantly spaced.

72. The drumstick recited in claim 67, wherein said drumstick is made of a synthetic material selected from a group consisting of nylon, graphite, ceramic, and plastic.

73. The drumstick recited in claim 67, wherein said drumstick is a plastic selected from a group consisting of polycarbonate, polyamide, polyvinyl chloride, phenol formaldehyde, polymethyl metacrylate, and polypropylene.

74. The drumstick recited in claim 67, wherein each of said substantially circumferential protuberances is substantially square in shape.

75. The drumstick recited in claim 67, wherein each of said substantially circumferential protuberances is substantially V-shaped.

76. The drumstick recited in claim 67, wherein each of said substantially circumferential protuberances is substantially U-shaped.

77. The drumstick recited in claim 67, wherein a plurality of said plurality of substantially circumferential protuberances intersects.

78. The drumstick recited in claim 67, wherein at least one of said plurality of substantially circumferential protuberances is partially grooved.

* * * * *